US007347389B2

(12) United States Patent
Ohnmacht et al.

(10) Patent No.: US 7,347,389 B2
(45) Date of Patent: Mar. 25, 2008

(54) FUEL INJECTION VALVE FOR INTERNAL COMBUSTION ENGINES

(75) Inventors: Markus Ohnmacht, Stuttgart (DE); Patrick Mattes, Stuttgart (DE); Werner Teschner, Stuttgart (DE); Wilhelm Christ, Ludwigsburg (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/526,308

(22) PCT Filed: Apr. 25, 2003

(86) PCT No.: PCT/DE03/01350

§ 371 (c)(1),
(2), (4) Date: Mar. 2, 2005

(87) PCT Pub. No.: WO2004/031570

PCT Pub. Date: Apr. 15, 2004

(65) Prior Publication Data

US 2005/0284964 A1 Dec. 29, 2005

(30) Foreign Application Priority Data

Sep. 27, 2002 (DE) ..... 102 45 573

(51) Int. Cl.
*B05B 1/30* (2006.01)

(52) U.S. Cl. ..... 239/584; 239/533.12; 239/533.3

(58) Field of Classification Search ..... 239/533.11, 239/533.12, 533.13, 533.14, 533.15, 584
See application file for complete search history.

(56) References Cited

U.S. PATENT DOCUMENTS

| | | | | |
|---|---|---|---|---|
| 1,952,816 | A * | 3/1934 | Mock | 239/488 |
| 2,407,915 | A * | 9/1946 | Ball | 239/464 |
| 5,890,660 | A * | 4/1999 | Stevens | 239/533.3 |
| 6,427,932 | B1 | 8/2002 | Danckert et al. | |
| 6,565,017 | B1 * | 5/2003 | Fath et al. | 239/533.3 |
| 6,666,388 | B2 * | 12/2003 | Ricco | 239/533.9 |
| 6,776,358 | B2 * | 8/2004 | Arimoto | 239/533.3 |
| 6,811,105 | B2 * | 11/2004 | Kato et al. | 239/533.2 |
| 6,892,965 | B2 * | 5/2005 | Haeberer et al. | 239/533.12 |
| 6,923,388 | B2 * | 8/2005 | Buehler | 239/533.2 |
| 7,011,256 | B2 * | 3/2006 | Schorr et al. | 239/533.2 |

(Continued)

FOREIGN PATENT DOCUMENTS

DE 100 20 148 A1 11/2000

(Continued)

*Primary Examiner*—Dinh Q. Nguyen
*Assistant Examiner*—Trevor McGraw
(74) *Attorney, Agent, or Firm*—Ronald E. Greigg

(57) ABSTRACT

A fuel injection valve for internal combustion engines, having a valve body with a bore defined on its end toward the combustion chamber by a conical valve seat, with a valve needle disposed longitudinally displaceably in the bore and a sealing face with two sealing portions on its end toward the combustion chamber with the second conical face being disposed on the combustion chamber side of the first conical face. An annular groove extending between the conical faces has an end facing away from the combustion chamber which acts as a sealing edge upon contact of the valve sealing face with the valve seat. Recesses embodied in the valve seat and/or on the valve sealing face hydraulically connect the annular groove with a portion of the second conical face located on the combustion chamber side of the annular groove.

23 Claims, 9 Drawing Sheets

U.S. PATENT DOCUMENTS

| | | | | |
|---|---|---|---|---|
| 2002/0179743 | A1 | 12/2002 | Haeberer et al. | |
| 2003/0057299 | A1 | 3/2003 | Itoh | |
| 2005/0178860 | A1* | 8/2005 | Christ et al. ..... | 239/533.12 |
| 2006/0011749 | A1* | 1/2006 | Kuegler et al. ..... | 239/533.12 |

FOREIGN PATENT DOCUMENTS

| | | | |
|---|---|---|---|
| DE | 100 00 574 | A1 | 7/2001 |
| GB | 2 232 203 | A | 12/1990 |
| JP | 2000-265927 | A | 9/2000 |
| JP | 2001-12334 | | 1/2001 |
| WO | WO 02/01066 | A1 | 1/2002 |
| WO | WO0201066 | * | 1/2002 |

* cited by examiner

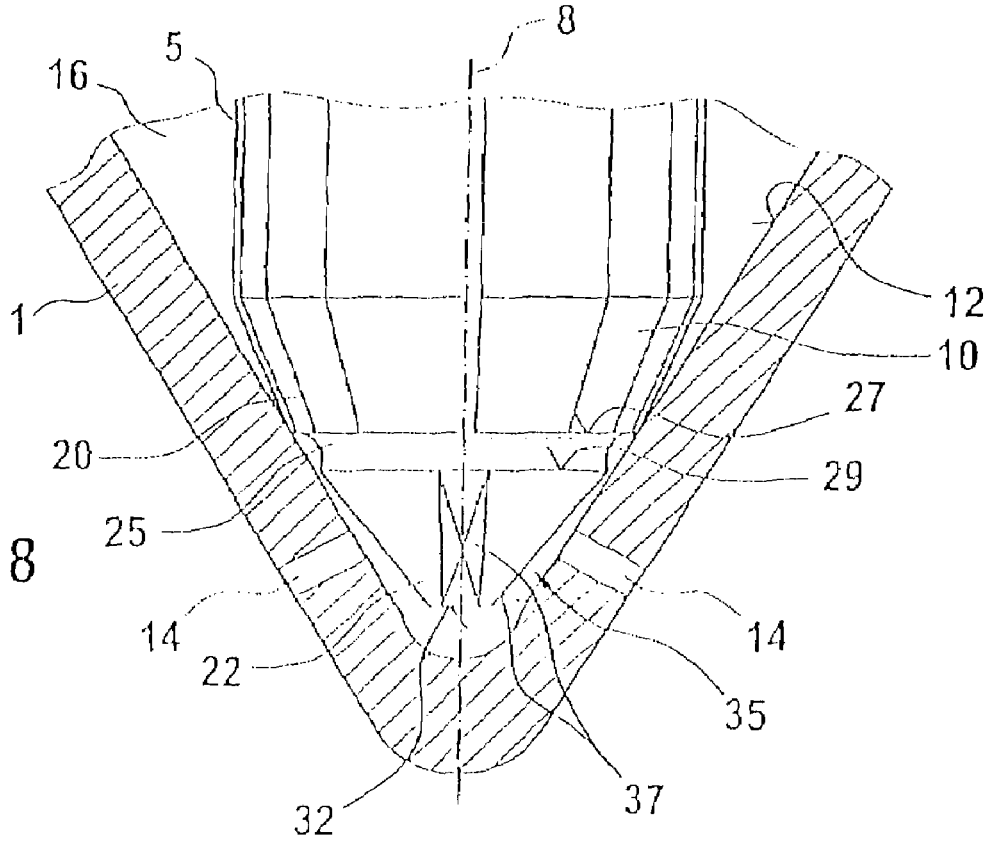
Fig. 8
Fig. 8a
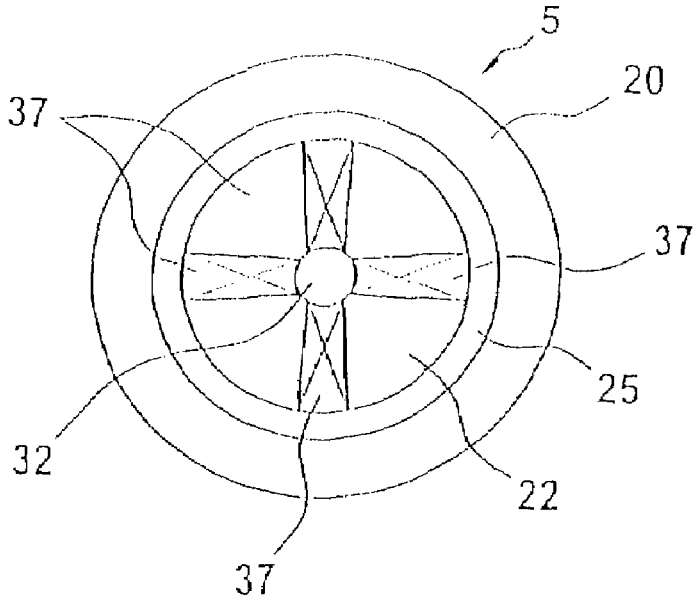

FUEL INJECTION VALVE FOR INTERNAL COMBUSTION ENGINES

CROSS-REFERENCE TO RELATED APPLICATIONS

This application is a 35 USC 371 application of PCT/DE03/01350 filed on Apr. 25, 2003.

BACKGROUND OF THE INVENTION

1. Field of the Invention

The invention is directed to an improved fuel injection valve for internal combustion engines.

2. Description of the Prior Art

International Patent Disclosure WO 96/19661 shows a fuel injection valve with a valve body, in which a bore is embodied that is defined on its end toward the combustion chamber by a conical valve seat. A pistonlike valve needle is disposed longitudinally displaceably in the bore and has an essentially conical valve sealing face on its end toward the combustion chamber. The valve sealing face is separated into two conical faces, which are separated from one another by an annular groove. The opening angle of the two conical faces and the opening of the conical valve seat are adapted to one another in such a way that upon contact of the valve needle with the valve seat, the edge that is embodied at the transition from the annular groove to the first conical face comes to rest on the valve seat and acts as a sealing edge, in order to control the flow of fuel to at least one injection opening that originates at the valve seat and discharges into the combustion chamber of the engine.

The second edge of the annular groove, which along with the sealing edge defines the annular groove and is embodied at the transition to the second conical face at the valve sealing face, is spaced apart from the valve seat in the closing position of the valve needle, or in other words when the valve needle comes to rest with its sealing edge on the valve seat. The valve needle is kept in its closing position by a closing force because a closing force that presses the valve needle against the valve seat acts on its end facing away from the combustion chamber. In order for the valve needle to uncover the injection openings, a hydraulic contrary force that exceeds the closing force must act on the valve needle. Given a suitable pressure in the pressure chamber that is embodied between the valve needle and the wall of the bore, the result is a corresponding hydraulic force exerted, among other places, on parts of the valve sealing face, resulting in a corresponding opening force oriented counter to the closing force. If the valve needle then lifts from the valve seat, fuel flows out of the pressure chamber to the injection openings between the valve seat and the valve sealing face.

In the partial stroke range, that is, before the valve needle has reached its maximum opening stroke, the problem arises that because of the inflowing fuel that prevails in the pressure chamber at high pressure, the pressure in the annular groove also rises. A further flow to the injection openings is initially possible only in throttled fashion, since the gap between the second edge of the annular groove and the valve seat assures a corresponding throttling effect, especially whenever, over the course of usage, the spacing between the second edge and the valve seat becomes increasingly less because of wear, or even vanishes entirely in the closing position of the valve needle. This elevated pressure in the annular groove causes an additional opening force on the valve needle that is not initially present and that changes the opening speed and hence also the instant at which the valve needle reaches its maximum opening. Thus over time, the opening dynamics of the valve needle and hence the fuel quantity injected vary. For precise fuel injection of the kind necessary in high-speed, self-igniting internal combustion engines, this change in the opening dynamics means that optimal injection in terms of pollutant emissions and fuel consumption is no longer assured.

SUMMARY AND ADVANTAGES OF THE INVENTION

The fuel injection valve of the invention has the advantage over the prior art that the opening dynamics of the valve needle remain constant over its entire service life. To that end, recesses are embodied on the valve sealing face that hydraulically connect the annular groove with a portion of the second conical face located on the combustion chamber side of the annular groove. In the partial stroke range of the valve needle, no additional fuel pressure can therefore build up in the annular groove, since the fuel is diverted through the recesses into the chamber that is embodied between the valve seat and the second conical face. This chamber communicates in turn with the combustion chamber via the injection openings, so that reliable pressure relief of the annular groove in the partial stroke range is assured. Not until the maximum stroke is attained does the fuel flow out of the pressure chamber into these regions of the valve sealing face as well and assure the appropriate pressure increase for injection of the fuel into the combustion chamber at high pressure.

Advantageous features of the subject of the invention are disclosed. In a first advantageous feature, the invention is embodied as a roughening of the valve sealing face. The roughening is directly adjacent to the annular groove and is thus disposed on the second conical face. Such roughening can be produced in a simple way, either with a laser or by an etching process.

In a further advantageous feature, the recesses are embodied as many elongated grooves. By means of a suitable total cross section of the grooves, a suitable cross section at which pressure relief of the annular groove is assured can be attained. These grooves can advantageously be embodied in various ways. It is especially advantageous if the grooves are embodied as microscopic grooves whose depth is less than 50 μm. Such shallow microscopic grooves do not impair the stability of the valve needle in the region of the valve seat, yet nevertheless a suitable cross section that suffices for pressure relief of the annular groove can be attained by way of the number of grooves. It is especially advantageous in this respect if the depth of the grooves is greater than their width, since then the surface area with which the valve needle can be seated on the valve seat increases for the same flow cross section. This reduces wear in the region of the valve seat and thus lengthens the service life of the fuel injection valve.

In a further advantageous feature, the structured surface is formed by elongated grooves whose end facing away from the combustion chamber is located inside the elongated groove. Such grooves offer the advantage of being simpler to make. If the elongated groove begins precisely at the second edge of the elongated groove, then it is not always possible in the manufacturing process to place the beginning of the elongated groove exactly at the second edge. However, if the elongated groove begins inside the elongated groove, then the precise position of the end toward the combustion chamber of the elongated grooves does not matter.

In a further advantageous feature, the recesses are embodied as many elongated grooves which are curved in an S shape. Grooves designed in this way have the advantage of being faster and hence more favorable to produce. In manufacture by a laser process, the needle must be correspondingly rotated so that the laser device will make the groove at the correct point on the valve sealing face. To that end, the valve needle is rotated by a defined angle about its longitudinal axis and remains in this position until the groove has been made by the laser, and then rotates onward again. With grooves curved in an S shape, however, it is possible to rotate the valve needle continuously, so that a curved groove is created in the course of the motion of the laser along the longitudinal axis of the valve needle.

In a further advantageous feature, the width of the elongated grooves varies, from their end facing away from the combustion chamber to their end facing toward the combustion chamber. In this respect, it is especially advantageous if the width decreases in that direction. As a result, a rapid diversion of the fuel from the annular groove and a corresponding reduction in throttling at the second edge of the annular groove are attained, and because of the decreasing cross section of the grooves toward the injection openings, the flow conditions between the valve seat and the valve sealing face at least approximately again correspond to those of the known fuel injection valves, so that identical inflow conditions into the respective injection openings are also attained.

In a further advantageous feature, the recesses are embodied as polished plane sections, which are embodied on the second conical face. Such polished plane sections can be produced with little effort, making economical manufacture possible.

In a further advantageous feature, the conical valve seat is adjoined toward the combustion chamber by a dead-end volume, from which the at least one injection opening extends. Advantageously, the grooves extend so far in the direction of the combustion chamber that they reach at least as far as the transitional edge between the conical valve seat and the dead-end volume. As a result, in addition to a pressure relief of the annular groove, the advantage is also attained that the throttling at the transitional edge is reduced, and hence the fuel can flow into the dead-end volume with fewer losses.

In a further fuel injection valve according to the invention, the recesses are embodied on the valve seat, and these recesses hydraulically connect the annular groove to a portion of the valve seat located on the combustion chamber side of the annular groove. Hydraulically, these recesses function identically, so that once again a pressure buildup in the annular groove upon a partial stroke of the valve needle is averted.

In an advantageous feature this embodiment the grooves extend between the injection openings, which here begin at the valve seat. As a result, the inflow conditions into the injection openings are unchanged compared to the conventional injection valves, so that no adaptation has to be made in this respect. However, it may also be advantageous to use the grooves for a uniform inflow of the fuel into the injection openings. To that end, the grooves extend beyond the injection openings, so that if the valve needle comes to be in a slightly skewed position, the uniform inflow of fuel is not impaired.

It is especially advantageous if the recesses are produced by a laser process, since with it, it is economically possible to produce virtually arbitrarily structured surfaces that cannot be produced, or can be produced only at considerably greater effort, by mechanical processing methods.

BRIEF DESCRIPTION OF THE DRAWINGS

Other features and advantages of the invention will become apparent from the description contained herein below, taken in conjunction with the drawings, in which:

FIG. 5, FIG. 6 FIG. 7 and FIG. 8 show the same detail as FIG. 2 for further exemplary embodiments;

DESCRIPTION OF THE PREFERRED EMBODIMENTS

Figure 1:
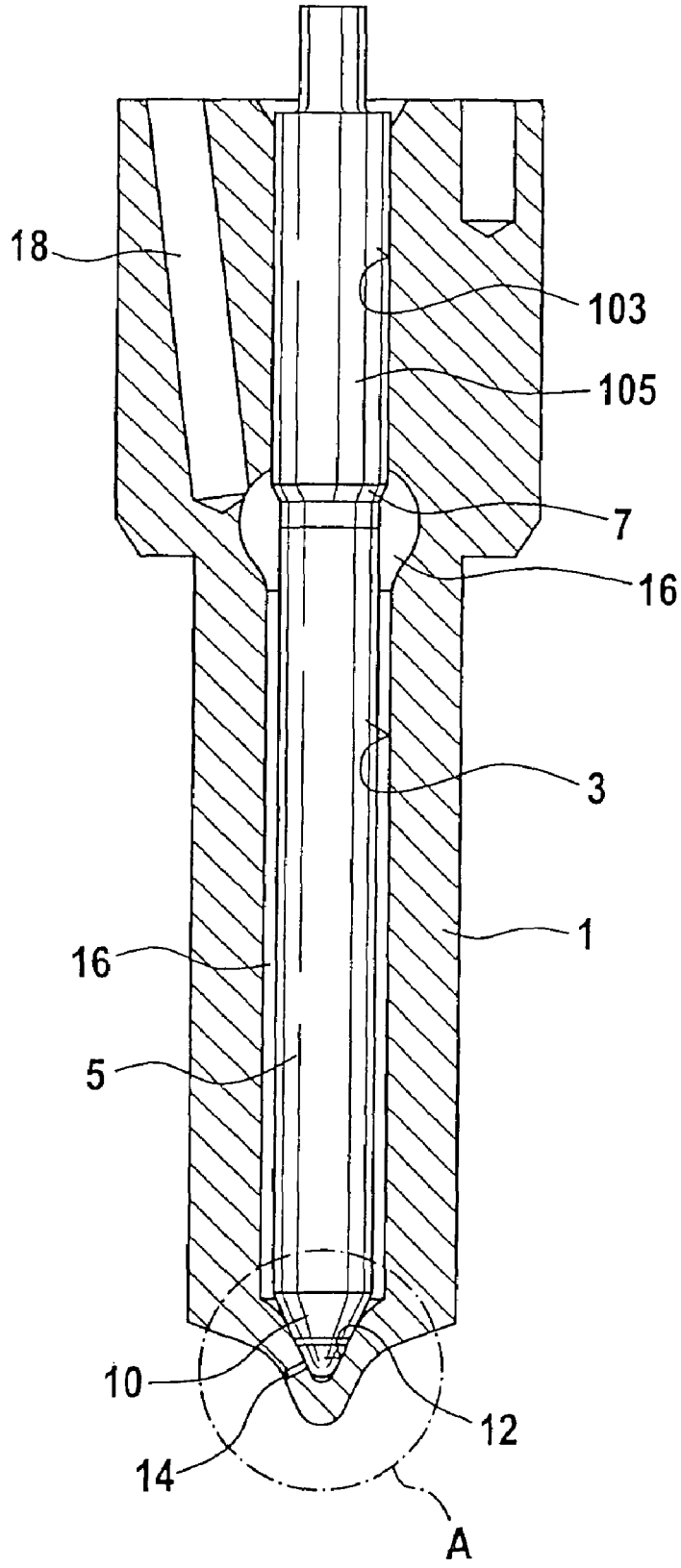
FIG. 1 is a longitudinal section through a fuel injection valve of the invention.

FIG. 1 shows a fuel injection valve of the invention in longitudinal section. In a valve body 1, a bore 3 is embodied that is defined on its end toward the combustion chamber by a conical valve seat 12. At least one injection opening 14 extends away from the valve seat 12 and, in the installed position of the fuel injection valve, it discharges into the combustion chamber of the internal combustion engine. A pistonlike valve needle 5 is disposed longitudinally displaceably in the bore 3 and is guided with a guided portion 105 in a guide portion 103 of the bore 3. Beginning at the guided portion 105 of the valve needle 5, the valve needle 5 narrows toward the valve seat 12, forming a pressure shoulder 7, and at its end toward the combustion chamber it changes over into a valve sealing face 10. In its closing position, the valve needle 5 rests with the valve sealing face 10 on the valve seat 12 and thus closes off the injection openings 14 from a pressure chamber 16 embodied between the valve needle 5 and the wall of the bore 3. The pressure chamber 16 is radially widened at the level of the pressure shoulder 7, and an inlet conduit 18 which extends in the valve body 1 and by way of which the pressure chamber 16 can be filled with fuel at high pressure discharges into the radially enlarged part of the pressure chamber 16.

On its end toward the combustion chamber, the valve needle 5 is urged in the direction of the valve seat 12 by a constant or variable closing force. A suitable device for this is a spring, for instance, or a device that generates the closing force hydraulically. By means of a longitudinal motion of the valve needle 5 counter to the closing force, a gap between the valve sealing face 10 and the valve seat 12 is opened up, so that fuel can flow out of the pressure chamber 16 to the injection openings 14 and from there is injected into the combustion chamber of the engine. The corresponding opening force, oriented counter to the closing force, is generated here by the hydraulic force on parts of the valve sealing face 10 and by the pressure shoulder 7. By means of a variable pressure in the pressure chamber 16 or by a variation in the closing force on the valve needle 5, the ratio between the opening force and closing force can be varied and the valve needle 5 can be moved accordingly in the bore 3.

Figure 2:
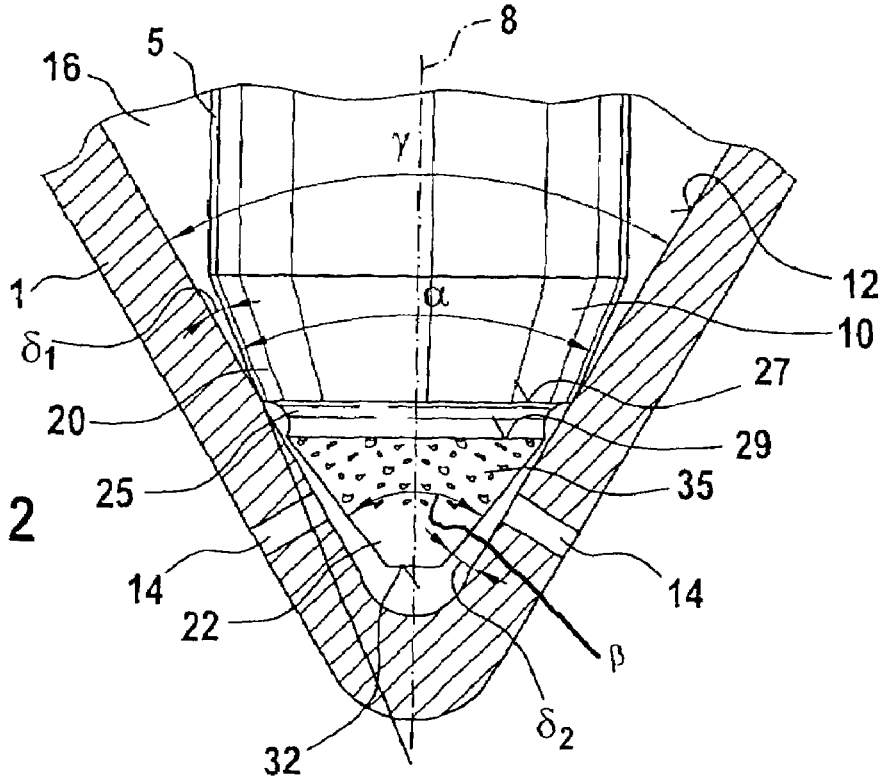
FIG. 2 is an enlargement of the detail marked A in FIG. 1.

FIG. 2 shows an enlargement of FIG. 1 at the detail marked A. The valve sealing face 10 includes a first conical face 20 and a second conical face 22; the second conical face 22 is embodied toward the combustion chamber relative to the first conical face 20. Between the first conical face 20 and the second conical face 22, an annular groove 25 is embodied, and a sealing edge 27 is embodied at the transition from the first conical face 20 to the annular groove 25, and a second edge 29 is embodied at the transition from the annular groove 25 to the second conical face 22. The opening angle $\alpha$ of the first conical face 20 is smaller than the opening angle $\gamma$ of the conical valve seat 12, so that a differential angle $\delta_1$ is embodied between the first conical face 20 and the valve seat 12. The opening angle $\beta$ of the second conical face 22 is larger than the opening angle $\gamma$ of the valve seat 12, so that a differential angle $\delta_2$ is embodied between the second conical face 22 and the valve seat 12. Preferably, the differential angle $\delta_1$ is smaller than the differential angle $\delta_2$. As a result of this embodiment of the conical faces 20, 22 and of the conical valve seat 12, the valve sealing face 10 cooperates with the valve seat 12 in such a way that upon contact of the valve needle 5 with the valve seat 12, the valve sealing face rests on the valve seat 12 in the region of the sealing edge 27. As a result, in this region, a relatively high pressure per unit of surface area is obtained, which makes secure sealing off of the pressure chamber 16 from the injection openings 14 possible. The second edge 29 of the annular groove 25, at least when the fuel injection valve is new, does not rest on the valve seat 12, but this spacing may decrease from wear over the course of operation and finally cause the second edge 29 also to rest on the valve seat 12 in the closing position of the valve needle 5. On the second conical face 22 and directly adjoining it on the annular groove 25, recesses 35 are embodied which establish a hydraulic communication between the annular groove 25 and the chamber that is formed between the second conical face 22 and the valve seat 12.

At the outset of the opening stroke motion of the valve needle 5, a high pressure prevails in the pressure chamber 16 and acts on the first conical face 20, which exerts some of the opening force on the valve needle 5. Immediately after the valve needle 5 lifts from the valve seat 12, a gap is opened up between the sealing edge 27 and the valve seat 12, through which gap fuel flows at high pressure out of the pressure chamber 16 into the annular groove 25, which until then was pressureless, so that the fuel pressure there rises. Although initially a slight annular gap is opened up between the second edge 29 and the valve seat 12, nevertheless because of the recesses 35 a wider flow cross section is available, so that the fuel is rapidly diverted from the annular groove 25, and the pressure rise there is only slight. Not until the further opening stroke motion, when a relatively large gap is opened up between the sealing edge 27 and the valve seat 12 and accordingly also between the second edge 29 and the valve seat 12 does a large amount of fuel flow at high pressure out of the pressure chamber 16 to the injection openings 14, so that a correspondingly high pressure now prevails in the annular groove 25 as well. At this instant, at which the valve needle 5 has completed its maximum opening stroke, the structured surface produced by recesses 35 no longer plays any decisive role in the flow conditions. At the onset of the opening stroke motion, because of the recesses 35, the hydraulic force from the pressure rise in the annular groove 25 is absent, so that the opening force is determined solely by the hydraulically effective surface area of the first conical face 20. The maximum opening stroke of the valve needle 5 is, as a rule, no longer than 0.2 mm.

The recesses 35 in the exemplary embodiment shown in FIG. 2 can be produced by etching, for instance, or by means of a laser, so that a hydraulic communication is established between the annular groove 25 and the second portion of the second conical face 22, that is, the portion located on the combustion chamber side of the annular groove.

Figure 3:
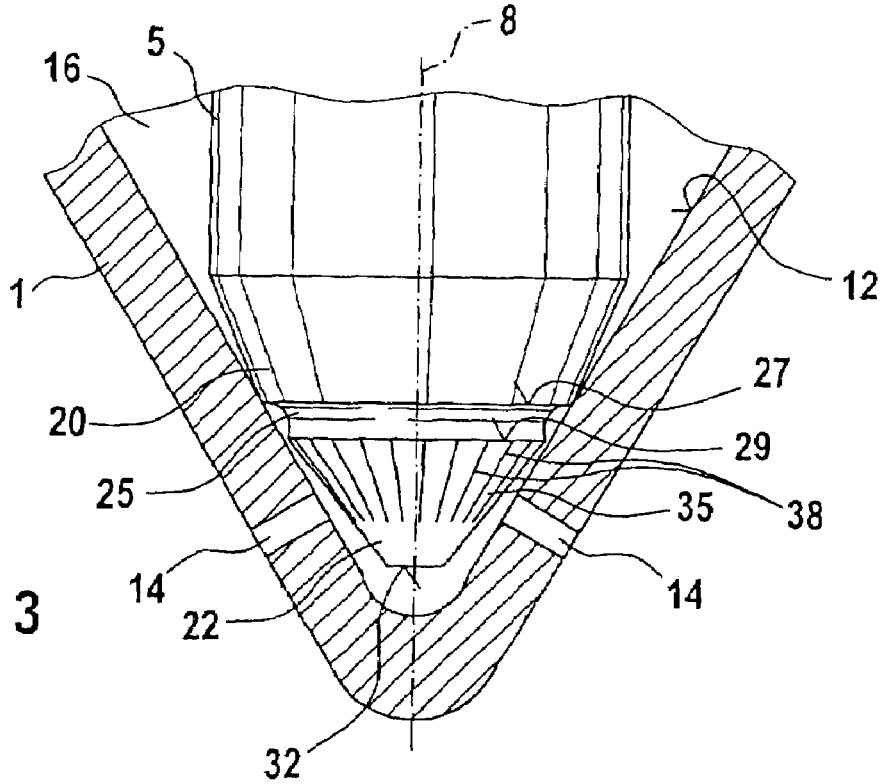
FIG. 3, the same detail as FIG. 2 for a further exemplary embodiment.

In FIG. 3, the same detail as in FIG. 2 is shown, for a different exemplary embodiment. Here the recesses 35 comprise many elongated grooves 38, whose end facing away from the combustion chamber coincides with the second edge 29, and which extend as far as a portion, located on the combustion chamber side of the annular groove 25, of the second conical face 22. Given a suitable depth, the elongated grooves 38 make an adequate cross section available, leading to a hydraulic relief of the annular groove 25 in the partial stroke range.

Figure 4A:
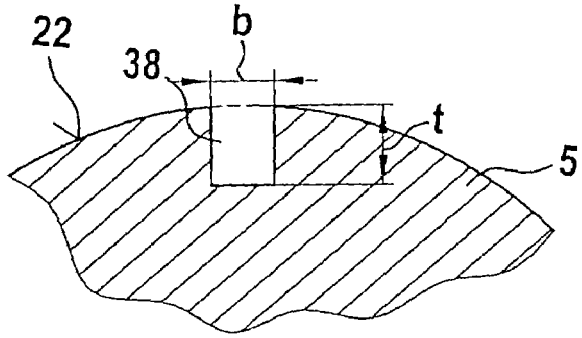
FIG. 4*a* and FIG. 4*b* are cross sections through a part of the valve needle in the region of a groove.
Figure 4B:
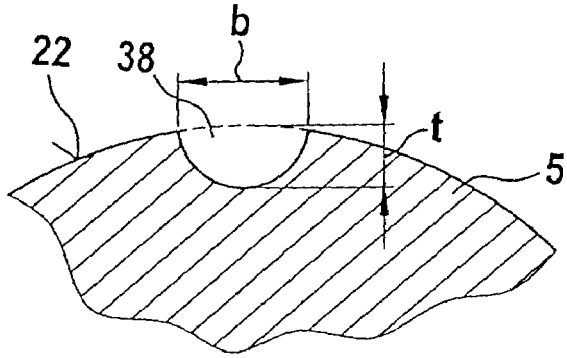

How far the elongated groove 38 extend on the second conical face 22 in the direction of the combustion chamber is determined by the differential angle $\delta_2$ and by the location of the injection openings 14. Here the grooves 38 extend beyond the injection openings 14. The grooves 38 are preferably produced in microstructured fashion; that is, they have a depth of preferably less than 50 μm. The width of the grooves 38, which are shown again in FIG. 4*a* in a cross section of the valve needle 5, is preferably from 5 μm to 50 μm. In order to remove as little material as possible from the second edge 29 as a result of the embodiment of the grooves 38 and thus to reduce the surface area with which the valve needle 5 rests on the valve seat 12 in the region of the second edge 29, the grooves 38 may be produced with a ratio of their width b to their depth t in which the depth t amounts to from one to ten times the width b. As a result, an only minimal reduction in the surface area is attained in the region of the second edge 29 while preserving the flow cross section that is sufficient to prevent the pressure increase in the annular groove 25 in the partial stroke range. Besides a rectangular cross section, as FIG. 4*a* shows, it is also possible for instance to produce the grooves 38 with an essentially semicircular cross section, as FIG. 4*b* shows. Depending on the manufacturing method employed, in general one particular cross section is easier to produce than another, so that whatever is the most favorable for the particular manufacturing process can be chosen.

Figure 5:
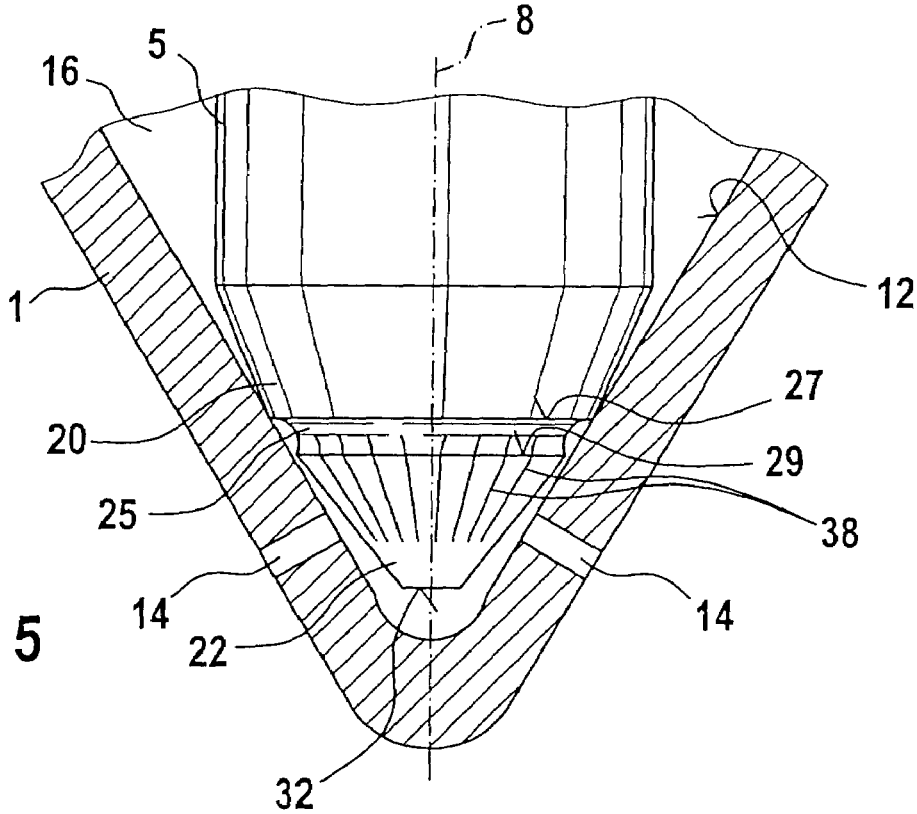

FIG. 5 shows a further exemplary embodiment, showing the same detail as in FIG. 3. The end of the grooves 38 facing away from the combustion chamber is located here inside the annular groove 25, and the grooves 38 extend along the second conical face 22. The embodiment of such grooves 38 is advantageous in the sense that from the standpoint of manufacture. it is difficult to embody the end of the grooves 38 facing away from the combustion chamber in such a way that it coincides precisely with the second edge 29. By embodying the end of the grooves 38 toward the combustion chamber approximately in the middle of the annular groove 25, with the grooves 38 extending beyond the second edge 29, problem-free manufacture of the grooves 38 is assured.

Figure 6:
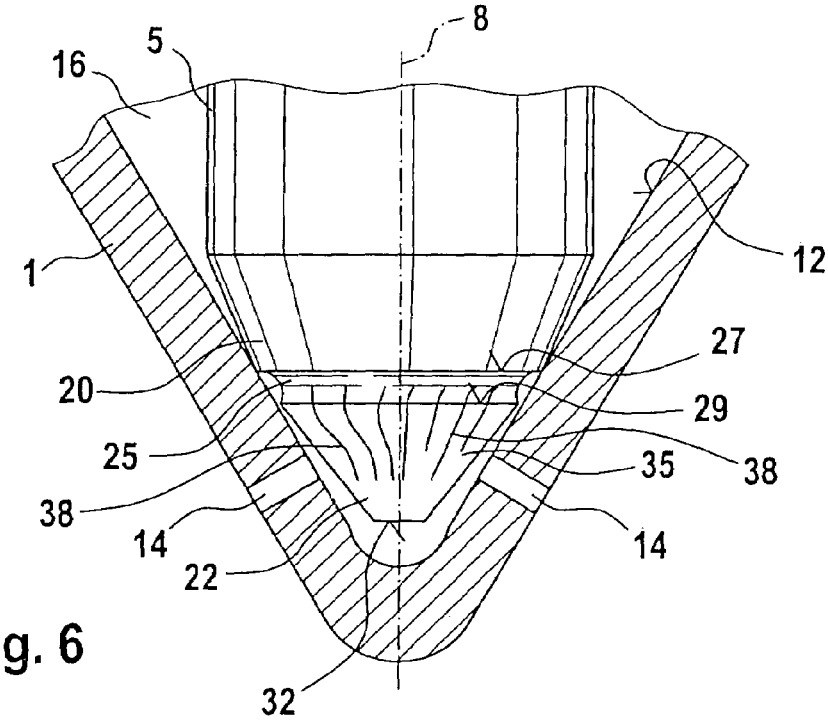

FIG. 6 shows a further exemplary embodiment, showing the same detail as in FIG. 3. The left half of FIG. 6 shows an exemplary embodiment in which the grooves 38 are embodied in a curved C or S shape. Such a shape of the grooves 38 is advantageous from the standpoint that in the manufacturing process by means of a laser, the laser beam moves along the second conical face 22 while the valve needle 5 is at rest. For making rectilinear grooves 38, the valve needle 5 must be kept constantly at rest, until the laser beam 5 makes the groove 38. This manufacturing process can be speeded up if the valve needle 5 is rotated continuously and the laser completes its motion under that condition, which makes it possible to speed up the manufacturing process. The resultant grooves 38 are curved but still meet their purpose of preventing the pressure increase in the annular groove 25. The right half of FIG. 6 shows a further exemplary embodiment in which alternating grooves 38 have different lengths. Since the throttling is to be prevented essentially at the second edge 29 and in the immediate vicinity of the second conical face 22, a large cross section of the grooves 38 in this region is required. In the portions of the second conical face 22 located closer to the combustion chamber, relief by means of the grooves 38 is longer possible to that extent, so that only a few grooves 38 are sufficient there.

Figure 7:
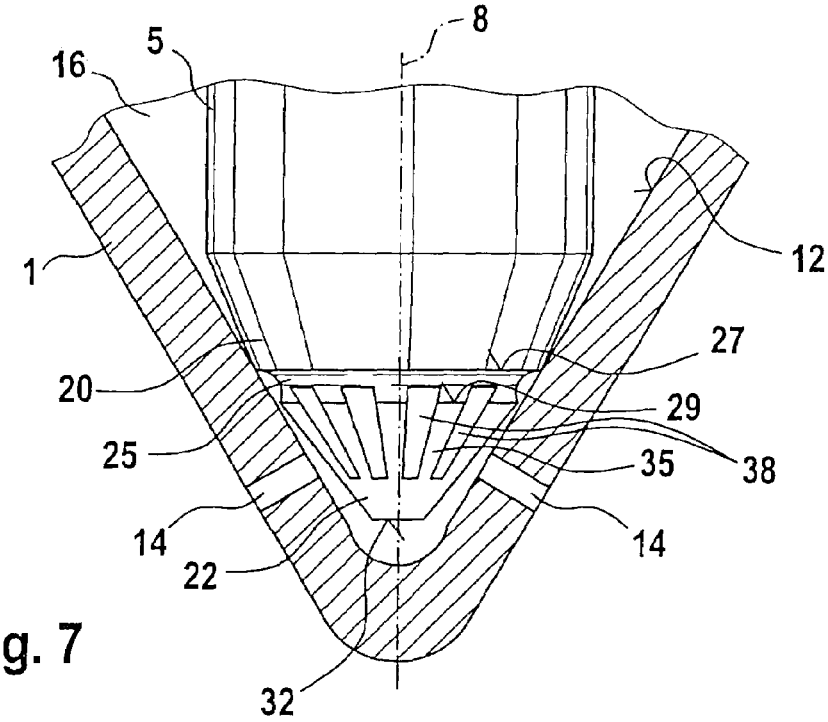

In FIG. 7, a further exemplary embodiment is shown, again showing the same detail as in FIG. 3. In this emobodiment the grooves 38 have a non-constant width. On the end facing away from the combustion chamber, that is, in the region of the annular groove 25 and of the second edge 29, there is a greater width than at the end toward the combustion chamber of the grooves 38, which assures good unthrottling of the annular groove 25. As an alternative, it may be provided that the grooves 38 have a non-constant depth, with the greatest depth located in the region of the annular groove 25 or at the second edge 29, with the depth of the grooves 38 decreasing continuously toward their end toward the combustion chamber.

In FIG. 8, a further exemplary embodiment is shown, in which the recesses 35 are embodied as polished plane sections 37. FIG. 8*a* shows a plan view on the valve needle 5 in which the disposition of the polished plane sections 37 is shown clearly. In this exemplary embodiment, four polished plane sections 37 are disposed on the second conical face 22; they extend from the annular groove 25 to the end face 32 and assure the hydraulic communication. The depth of the polished plane sections 37 may be varied; depending on the size of the polished plane sections 37, the load-bearing portion of the second conical face 22 varies, that is, the portion with which the second conical face 22 rests on the valve seat 12. The number of polished plane sections 37 may be selected freely, but advantageously at least two polished plane sections 37 will be provided, distributed uniformly over the circumference of the second conical face 22, in order to attain a uniform distribution of the contact pressures of the valve needle 5 on the valve seat 12.

Figure 9:
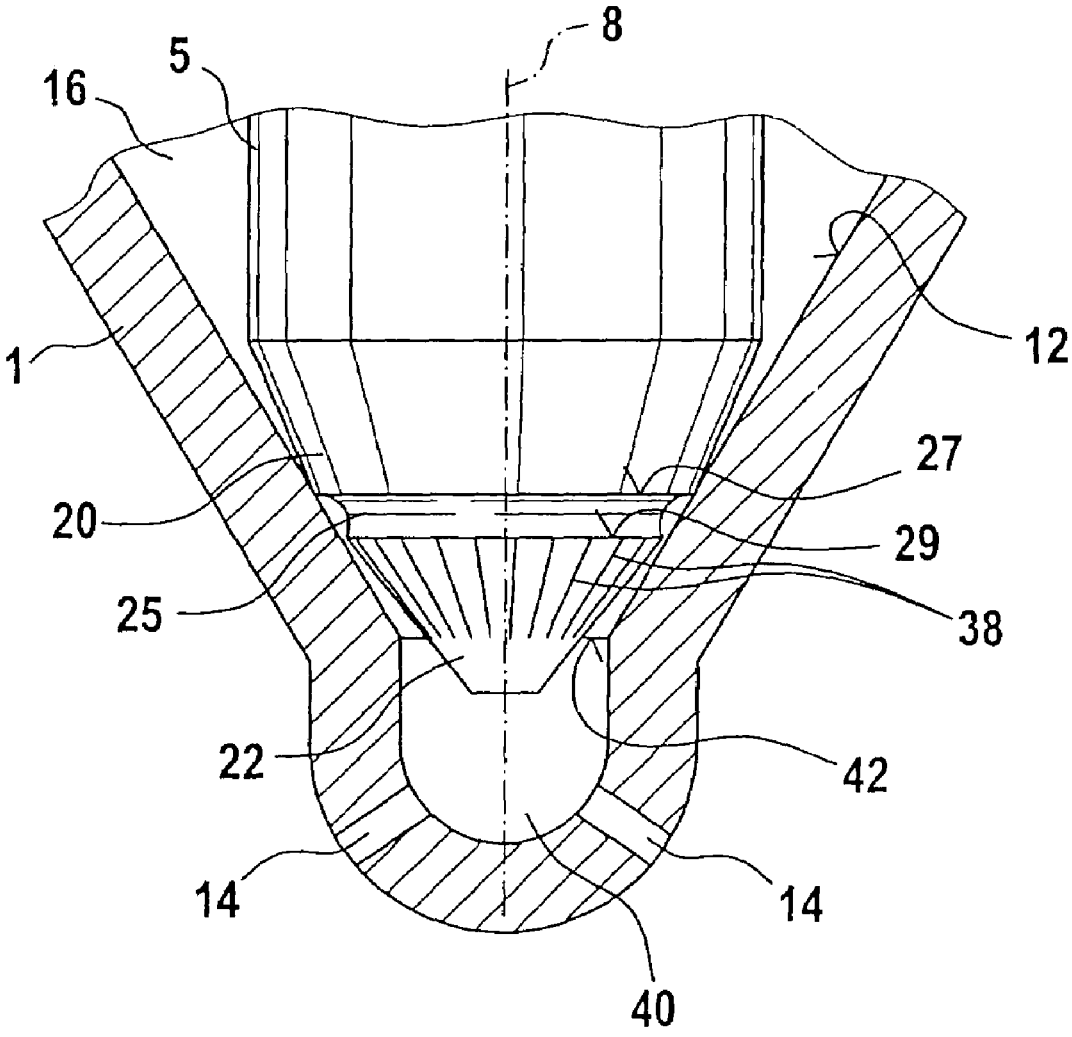
FIG. 9, once again, shows the same detail as FIG. 2, but here the valve body is slightly modified on its end toward the combustion chamber compared with the embodiment shown in FIG. 1.

In FIG. 9, a further exemplary embodiment is shown, in which the valve body 1 is embodied differently from the exemplary embodiments described above in the region of the valve seat 12. The conical valve seat 12 is adjoined toward the combustion chamber by a dead-end volume 40, and a transitional edge 42 is embodied at the transition from the conical valve seat 12 to the dead-end volume 40. The grooves 38 are extended so far in the direction of the dead-end volume 40 that their end extends at least as far as the transitional edge 42. Besides the unthrottling of the annular groove 25 in the partial stroke range, the grooves 38 here have the effect that the throttling upon inflow into the dead-end volume 40 is also unthrottled in the region of the transitional edge 42. As a result, when the valve needle 5 is fully open, the fuel flows into the dead-end volume 40 with smaller losses, so that injection is effected at higher pressures through the injection openings 14 that lead away from the dead-end volume 40.

The number of grooves 38 disposed over the circumference of the valve needle 5 depends on the desired cross section. It has proved advantageous in this respect for there to be at least eight grooves distributed over the circumference of the second conical face 22. However, a markedly larger number of grooves 38 may also be provided and instead embodied with a suitably lesser depth.

Figure 10:
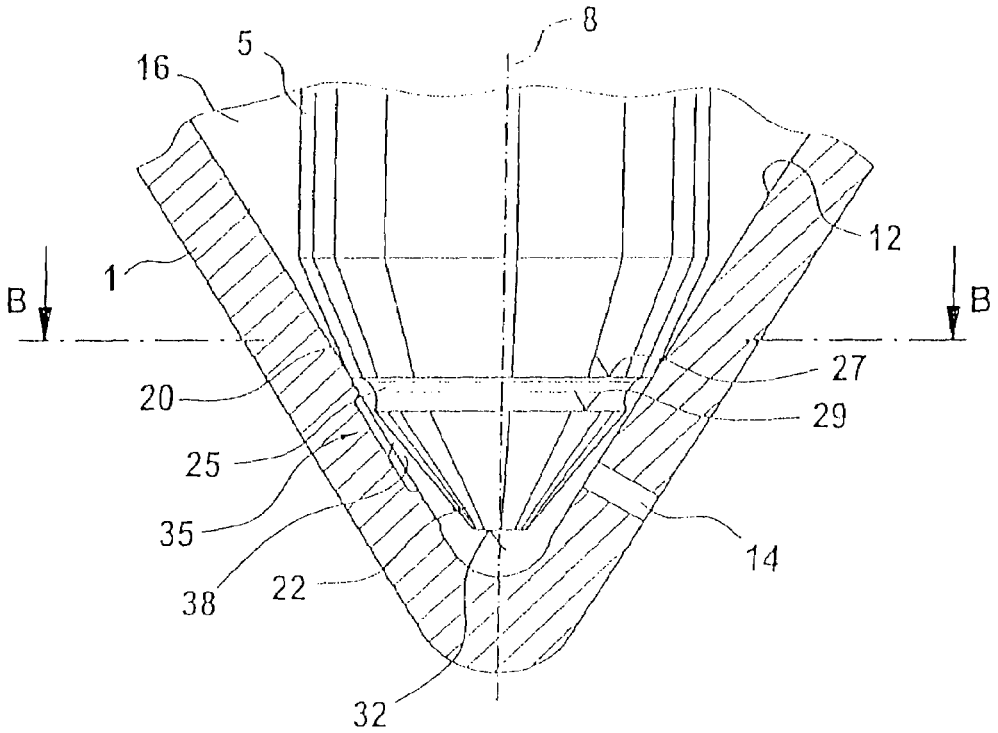
FIG. 10, an enlargement of the detail marked A in FIG. 1 for a further exemplary embodiment.
Figure 11:
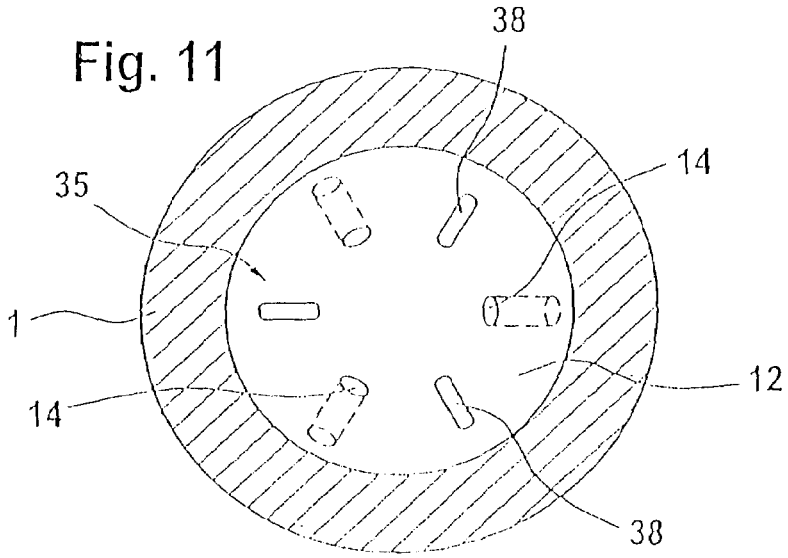
FIG. 11, a cross section through the fuel injection valve shown in FIG. 10, taken along the line B-B.

FIG. 10 shows a further exemplary embodiment of a fuel injection valve. Here the valve needle 5 has no recesses on the valve sealing face 10; instead, recesses 35 are embodied on the valve seat 12. The recesses 35 are embodied here as grooves 38, whose end facing away from the combustion chamber is located at the level of the annular groove 25 and which extend as far as the portion of the valve seat 12 located on the combustion chamber side of the annular groove 25. The grooves 38 here are embodied such that they do not intersect the injection openings 14 that originate at the valve seat 12. FIG. 11 shows a cross section through FIG. 10 along the line B-B, but the valve needle 5 has not been shown here. The grooves 38 can be seen, distributed in alternation with the injection openings 14 over the valve seat 12. For example, three injection openings 14 and grooves 38 are shown, but any other number may be provided instead. By means of this embodiment of the grooves 38, the inflow conditions for the injection openings 14 are unchanged from the known fuel injection valves, so that a new adaptation need not be performed here.

Figure 12:
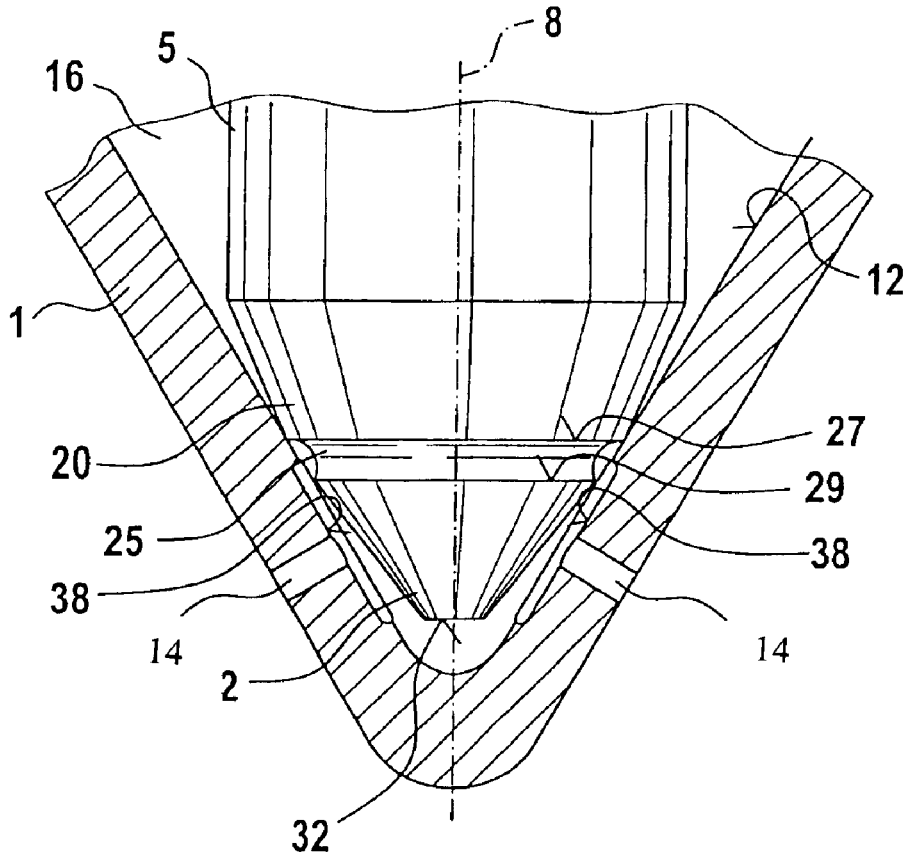
FIG. 12, the same detail as FIG. 10 for a further exemplary embodiment.
Figure 13:
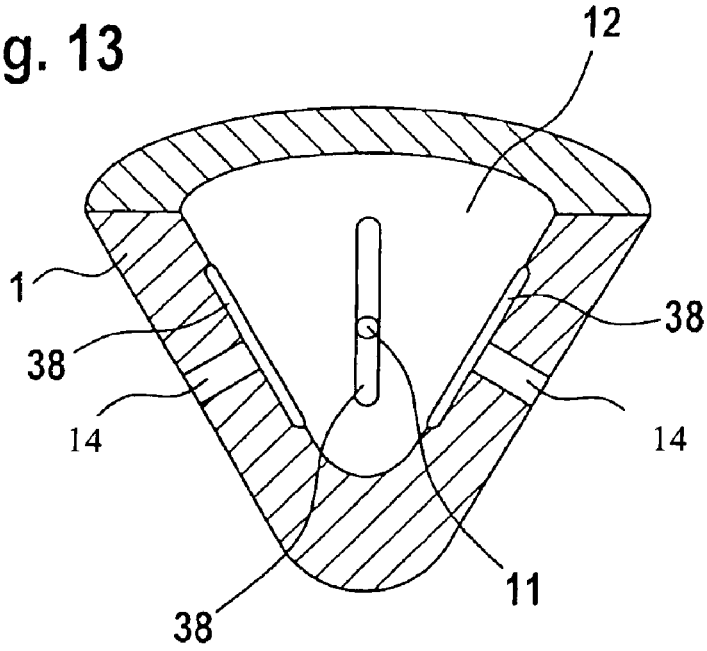
FIG. 13, a perspective view of the exemplary embodiment shown in FIG. 12 with the valve needle not shown.

In FIG. 12, the same view is shown as in FIG. 10 for a different exemplary embodiment; here the grooves 38 extend not between the injection openings 14 but beyond them. This has a further advantage: A slightly incorrect position of the valve needle 5 can occur in operation of the fuel injection valve causing the valve needle 5 to be slightly off axis and thus preventing the inflow of fuel to one or more of the injection openings 14, while the gap between the valve sealing face 10 and the valve seat 12 for the other injection openings 14 is too large. The consequence is uneven injection and hence an uneven distribution of fuel in the combustion chamber. By means of the disposition of the grooves 38, each injection opening 14 is supplied with fuel in a targeted way, so that skewing of the valve needle 5 has no substantial effect on the quantitative distribution of the fuel among the injection openings 14. FIG. 13 shows a perspective view of the valve body 1 of FIG. 12 without the valve needle 5, making the course of the grooves 38 on the valve seat 12 more visible.

Figure 14:
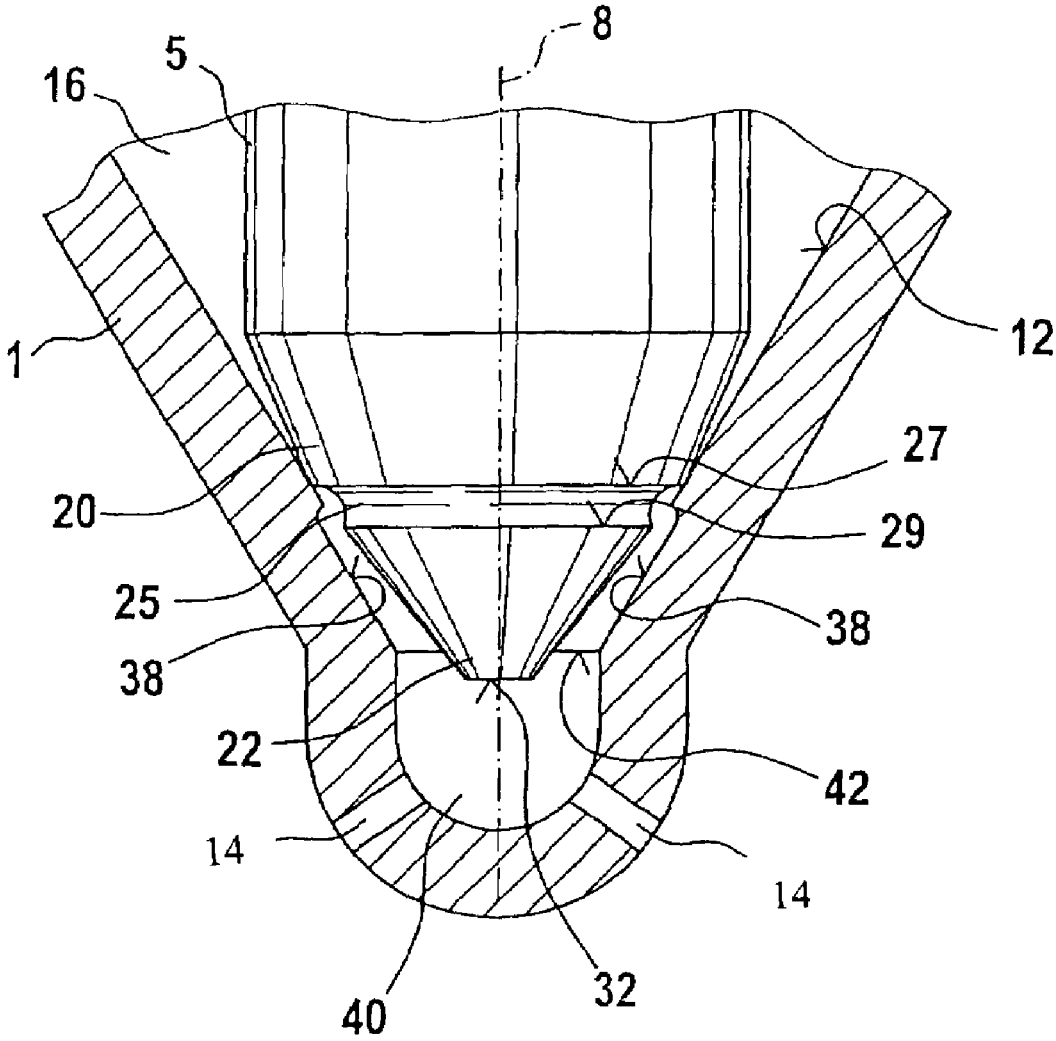
FIG. 14, the same view as FIG. 9 for a further exemplary embodiment.

In FIG. 14, the same view as in FIG. 9 is shown, that is, a fuel injection valve in which a dead-end volume 40 adjoins the valve seat. The recesses 35 here are once again embodied as grooves 38 in the valve seat 12, which extend as far as the transitional edge 42 from the conical valve seat 12 to the dead-end volume 40. Here, this has the additional effect that the throttling of the fuel flow at the transitional edge 42 is reduced upon inflow into the dead-end volume 40.

It may also be provided that recesses 35 are embodied both on the valve sealing face 10 and on the valve seat 12 and effect a corresponding hydraulic relief of the annular groove 25 in the partial stroke range. Arbitrary combinations of the exemplary embodiments shown in FIGS. 2 through 8 with those of FIGS. 9 through 13 are possible. The total flow cross section can thus be distributed among the recesses 35 at these faces, making a lesser depth of the individual recesses 35 possible for the same flow cross section.

The recesses 35 can be produced especially advantageously by means of a laser. With it, both a rough surface, as FIG. 2 shows, and arbitrary shapes and depths of the grooves 38 may be embodied.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection valve for internal combustion engines, the valve comprising a valve body (1) having a bore (3) defined on its end toward the combustion chamber of the engine by a conical valve seat (12), a pistonlike valve needle (5) disposed longitudinally displaceably in the bore (3), the valve needle (5) having a valve sealing face (10) that includes two conical faces (20; 22), on its end toward the combustion chamber the second conical face (22) disposed on the combustion chamber side of the first conical face (20), an annular groove (25) extending between the conical faces (20; 22), the end of the annular groove (25) facing away from the combustion chamber acting as a sealing edge upon contact of the valve sealing face (10) with the valve seat (12), and a plurality of recesses (35) embodied on the valve sealing face (10), the recesses (35) hydraulically connecting the annular groove (25) with a portion of the second conical face (22) located on the combustion chamber side of the annular groove (25), wherein the recesses (35) are embodied as a plurality of elongated grooves (38), and the elongated grooves (38) extend beyond the injection openings (14).

2. The fuel injection valve according to claim 1, wherein the recesses (35) are embodied as a roughening of the valve sealing face (10).

3. The fuel injection valve according to claim 1, wherein the recesses (35) are embodied as polished plane sections (37).

4. The fuel injection valve according to claim 1, wherein the valve sealing face (10) is adjoined toward the combustion chamber by a dead-end volume (40), from which at least one injection opening (14) extends away, and the recesses (35) extend at least as far as a transitional edge (42) defined between the dead-end volume (40) and the valve seat (12).

5. The fuel injection valve according to claim 1, wherein all the elongated grooves (38) begin in the same radial plane perpendicular to the valve needle (5) and intersect the annular groove (25), and extend from there in the direction of the combustion chamber.

6. The fuel injection valve according to claim 5, wherein the elongated grooves (38) have different lengths.

7. The fuel injection valve according to claim 1, wherein the elongated grooves (38) have a width (b) of 5 μm to 50 μm.

8. The fuel injection valve according to claim 1, wherein the elongated grooves (38) are embodied rectilinearly and extend along the second conical face (22).

9. The fuel injection valve according to claim 1, wherein the elongated grooves (38) are rectilinear and are inclined relative to the second conical face (22).

10. The fuel injection valve according to claim 1, wherein the depth (t) of the elongated grooves (38) is from 1 to 10 times their width (b).

11. The fuel injection valve according to claim 1, wherein the width (b) of the elongated grooves (38) decreases from their end facing away from the combustion chamber toward the combustion chamber.

12. The fuel injection valve according to claim 1, wherein the elongated grooves (38) are curved in a generally S shape.

13. The fuel injection valve according to claim 1, wherein the elongated grooves (38) extend as far as the end toward the combustion chamber of the valve needle (5).

14. The fuel injection valve according to claim 1, wherein the recesses (35; 38) are produced by a laser process.

15. A fuel injection valve for internal combustion engines, the valve comprising a valve body (1) having a bore (3) defined on its end toward the combustion chamber of the engine by a conical valve seat (12), a pistonlike valve needle (5) disposed longitudinally displaceably in the bore (3), the valve needle (5) having a valve sealing face (10) that includes two conical faces (20; 22) on its end toward the combustion chamber, the second conical face (22) being disposed on the combustion chamber side of the first conical face (20), an annular groove (25) extending between the conical faces (20; 22), the end of the annular groove (25) facing away from the combustion chamber, acting as a sealing edge upon contact of the valve sealing face (10) with the valve seat (12), and a plurality of recesses (35) embodied on the valve seat (12), the recesses (35) hydraulically connecting the annular groove (25) with a portion of the valve seat (12) located on the combustion chamber side of the annular groove (25).

16. The fuel injection valve according to claim 15, wherein the recesses (35) are embodied as rectilinear grooves.

17. The fuel injection valve according to claim 16, further comprising injection openings (14) extending away from the valve seat (12), the rectilinear grooves extending as far as the level of these injection openings (14).

18. The fuel injection valve according to claim 17, wherein the rectilinear grooves are located at a position between the injection openings (14).

19. The fuel injection valve according to claim 17, wherein the rectilinear grooves extend beyond the injection openings (14).

20. The fuel injection valve according to claim 15, further comprising a dead end volume (40) adjoining the valve seat (12) toward the combustion chamber, a plurality of injection openings (14) extending from the dead end volume (40), and rectilinear grooves embodied in the valve seat (12), the rectilinear grooves extending from the annular groove (25) to a transitional edge (42) of the valve seat (12) with the dead-end volume (40).

21. The fuel injection valve according to claim 15, wherein the recesses (35; 38) are produced by a laser process.

22. A fuel injection valve for internal combustion engines, the valve comprising a valve body (1) having a bore (3) defined on its end toward the combustion chamber of the engine by a conical valve seat (12), a pistonlike valve needle (5) disposed longitudinally displaceably in the bore (3), the valve needle (5) having a valve sealing face (10) that includes two conical faces (20; 22), on its end toward the combustion chamber the second conical face (22) disposed on the combustion chamber side of the first conical face (20), an annular groove (25) extending between the conical faces (20; 22), the end of the annular groove (25) facing away from the combustion chamber acting as a sealing edge upon contact of the valve sealing face (10) with the valve seat (12), and a plurality of recesses (35) embodied on the valve sealing face (10), the recesses (35) hydraulically connecting the annular groove (25) with a portion of the second conical face (22) located on the combustion chamber side of the annular groove (25), wherein the recesses (35) are embodied as a plurality of elongated grooves (38), wherein the end of the elongated grooves (38) facing away from the combustion chamber is located inside the annular groove (25).

23. A fuel injection valve for internal combustion engines, the valve comprising a valve body (1) having a bore (3) defined on its end toward the combustion chamber of the engine by a conical valve seat (12), a pistonlike valve needle (5) disposed longitudinally displaceably in the bore (3), the valve needle (5) having a valve sealing face (10) that includes two conical faces (20; 22), on its end toward the combustion chamber the second conical face (22) disposed on the combustion chamber side of the first conical face (20), an annular groove (25) extending between the conical faces (20; 22), the end of the annular groove (25) facing away from the combustion chamber acting as a sealing edge upon contact of the valve sealing face (10) with the valve seat (12), and a plurality of recesses (35) embodied on the valve sealing face (10), the recesses (35) hydraulically connecting the annular groove (25) with a portion of the second conical face (22) located on the combustion chamber side of the annular groove (25), wherein the recesses (35) are embodied as a plurality of elongated grooves (38), wherein the elongated grooves (38) are microscopic grooves, whose depth (t) is less than 50 μm.

* * * * *